United States Patent [19]

Reifenschweiler

[11] 3,968,373

[45] July 6, 1976

[54] DEVICE, IN PARTICULAR A NEUTRON GENERATOR, HAVING A DETACHABLE HIGH-VOLTAGE CONNECTION

[75] Inventor: Otto Reifenschweiler, Eindhoven, Netherlands

[73] Assignee: U.S. Philips Corporation, New York, N.Y.

[22] Filed: Sept. 6, 1974

[21] Appl. No.: 503,591

[30] Foreign Application Priority Data

Sept. 12, 1973 Netherlands ..... 7312546

[52] U.S. Cl. ..... 250/419; 250/501; 339/111

[51] Int. Cl.[2] ..... H05G 1/02; G21G 4/02

[58] Field of Search ..... 250/501, 502, 419; 339/111, 112 L

[56] References Cited

UNITED STATES PATENTS

| | | | |
|---|---|---|---|
| 2,241,687 | 5/1941 | Warnke | 339/112 L |
| 3,371,238 | 2/1968 | Beckurts et al. | 250/501 |
| 3,374,331 | 3/1968 | Brockhaus et al. | 339/111 |
| 3,417,245 | 12/1968 | Schmidt | 250/502 |

*Primary Examiner*—Harold A. Dixon
*Attorney, Agent, or Firm*—Frank R. Trifari; Ronald L. Drumheller

[57] ABSTRACT

A device, in particular a neutron generator, having a high voltage connection. A gap between a first and a second insulator of the said high voltage connection is filled with an insulating liquid, preferably oil. Said oil flows and preferably also serves for cooling parts at high voltage of the device, for example an ion source. As a result of this the dielectric strength of the device is considerably improved.

5 Claims, 1 Drawing Figure

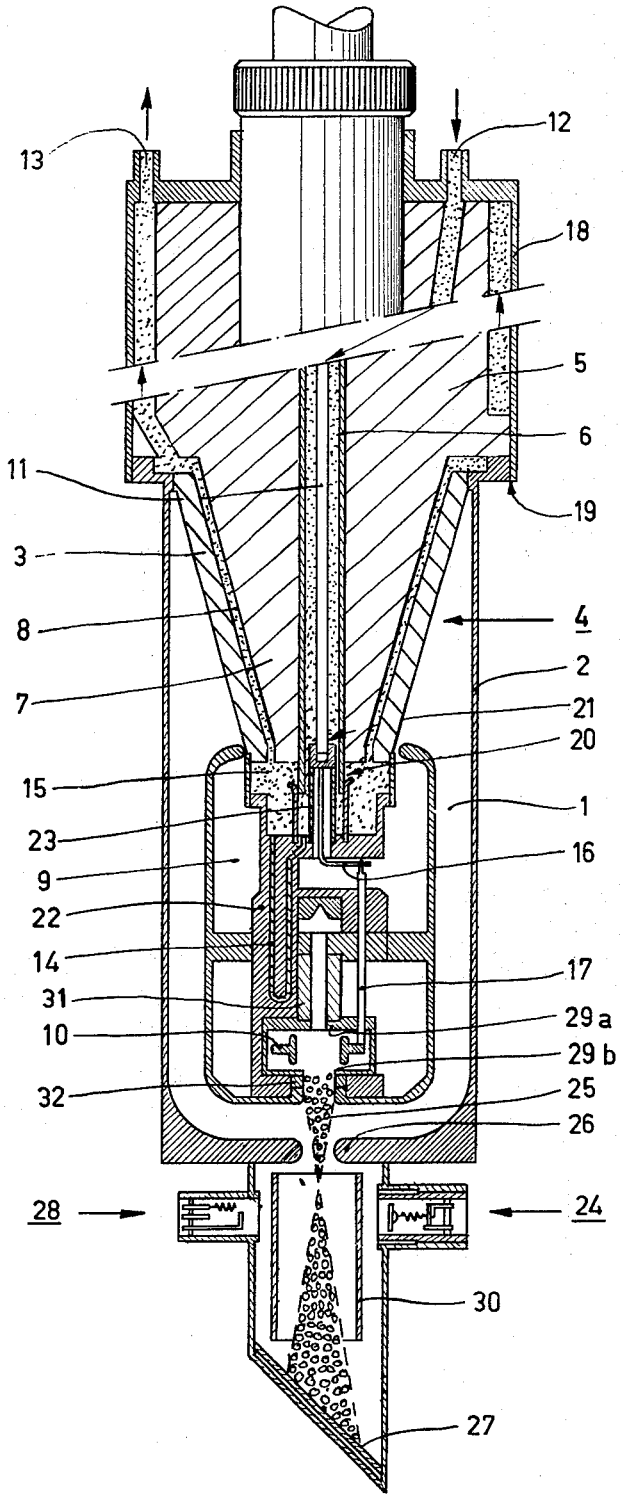
13
12
18
5
6
11
19
3
8
4
2
7
21
20
15
1
23
16
9
22
14
17
31
29 a
10
29 b
32
25
26
28
24
30
27

DEVICE, IN PARTICULAR A NEUTRON GENERATOR, HAVING A DETACHABLE HIGH-VOLTAGE CONNECTION

The invention relates to a device having a high voltage connection comprising a first insulator for supporting parts at high voltage of the device and a second insulator which comprises a second high voltage supply line, a gap between the said insulators being filled with an insulating liquid.

From the German Auslegeschrift 1,165,706 a high voltage connection is known in which insulating liquid is pressurized pneumatically in a gap between two insulators. In this high voltage connection the insulating liquid, for example oil, does not flow.

It is an object of the invention to the invention to improve the dielectric strength of such a high voltage connection. A further object of the invention is to provide a device having such a high voltage connection in which the insulating liquid is also used as a coolant.

According to the invention a device of the type mentioned in the first paragraph is characterized in that the device comprises an inlet and an outlet for the said insulating liquid and that the insulating liquid flows through the said gap. The insulating liquid preferably also flows through a cooling circuit in the said parts at high voltage.

By causing the insulating liquid to flow it is achieved that no so-called bridges are formed from contaminations in the insulating liquid. The flowing liquid may then also be used for dissipating thermal energy to, for example, a heat exchanger. The dielectric strength of the connection is considerably improved by the invention. In devices of the type mentioned in the first paragraph producing ionizing radiation, for example neutron generators and X-ray tubes, the insulating properties of said oil under the influence of the ionizing radiation would moreover reduce rapidly when the oil is stationary in the said gap. Since a large quantity of oil is used in a device according to the invention of which a small part is present in the device for a short time only and is then subjected to the ionizing radiation, the insulating properties of the oil are maintained for a long period of time so that the oil need be refreshed less often.

In a device according to the invention the said second insulator preferably has a conical part which comprises an axial duct for supplying or draining the insulating liquid.

A device according to the invention may be in particular a neutron generator having an ion source at high voltage with respect to metal parts of an envelope comprising a low pressure gas atmosphere, in which the said ion source is supported in the said envelope by a first fixed insulator which forms part of the said envelope and of a detachable high voltage connection, said high voltage connection furthermore comprising a second detachable insulator which has a high voltage supply line and comprises a conical part and an axial duct and in which an insulating cooling liquid flows in a circuit which is formed by the said axial duct, a cooling circuit in the said ion source and a gap between the said fixed and detachable insulators.

The drawing shows a cross-section of the preferred neutron generator.

The invention will be described in greater detail with reference to the accompanying drawing of a neutron generator according to the invention.

The neutron generator shown in the drawing comprises an envelope 1 which has a low pressure gas atmosphere and is provided with a metal part 2 and a fixed insulator 3. The fixed insulator 3 forms part of a detachable high-voltage connection 4 which furthermore comprises a detachable insulator 5 which comprises a high-voltage supply line 6. The insulator 3 is conical and the detachable insulator 5 also has a conical part 7. A narrow gap 8 is present between the insulator 3 and the conical part 7 of the insulator 5. An ion source 9 is supported in the envelope 1 by the fixed insulator 3. Via the high voltage supply line 6 a positive voltage of approximately 250 kV with respect to the grounded metal parts 2 of the envelope 1 is supplied to the ion source 9. The ion source 9 comprises an anode 10 which conveys a positive anode voltage of approximately 5 kV with respect to the cathodes 29*a* and 29*b* and the remaining metal parts of the ion source. Said anode voltage is supplied via a conductor 11 which is present coaxially in the high voltage supply line 6, and the conductors 16 and 17. In order to prevent breakdown, the gap 8 is filled with oil. The oil flows through the gap and is supplied via an inlet 12 and drained via an outlet 13. Via the space betwen the coaxial conductors 6 and 11 the oil reaches the ion source 9. In the ion source 9 the oil flows through a member of oil ducts of which one is denoted by 14 and which are provided in the metal part 22 of the ion source, and then reaches the space 15. From the space 15 the oil flows via the conical gap 8 to the outlet 13. The average flow rate of the oil in the gap 8 is approximately 10 m/min. With the described construction a large dielectric strength of the detachable high voltage connection 4 is achieved and also a good cooling of the ion source 9. A further advantage is that the quality of the oil used, for which any of the known insulating oils may be chosen, reduces only slowly as a result of the neutron radiation generated by the neutron generator. This is caused by the fact that a large quantity of oil is used which is circulated by pumping so that only a small part of the quantity of oil used in exposed to neutron radiation. As a result of this the reliability of the total equipment is considerably promoted. Upon disassembly of the high voltage connection 4 the detachable insulator 5 together with the conductors 6 and 11 and with the metal parts 18 of the envelope are removed. The separation between the parts 18 and the part 2 of the envelope takes place at 19. The separation between the high voltage supply line 6 and the ion source 9 takes place at 20. The separation between the conductor 11 and the conductor 16 takes place at 21. It is to be noted that the tube 23 is manufactured from insulation material. The anode voltage of 5 kV is set up across the tube 23. The space inside the tube 23 communicates with the evacuated space inside the ion source 9. From this it appears that upon disassembly of the high voltage connection 4, the vacuum, or rather the low pressure gas atmosphere, is maintained.

Although not strictly necessary for a good understanding of the above-described invention, the operation of the neutron generator will hereinafter be roughly described.

The neutron generator shown is of the sealed off type, that to say that during use it is not connected to a vacuum pump and is evacuated only once during the manufacture. The envelope 1 comprises a gas mixture consisting of 50% deuterium and 50% tritium with a pressure of approximately $10^{-3}$mm Hg. The gas mixture is supplied and the pressure thereof is maintained at the correct value by a pressure control 24. The pressure control comprises a large quantity of the gas mixture absorbed in a finely divided titanium powder, and can supply this by heating.

The mixture of deuterium and tritium is ionized in the ion source 9 by means of electrons which move in the electric field between the anode 10 and the cathodes 29*a* and 29*b* and in the axial magnetic field of the permanent magnets 31 and 32. So the ion source is of the known "Penning" type. A beam 25 consisting of positive deuterium ions and tritium ions having a current intensity of approximately 15mA is extracted from the ion source by the acceleration electrode 26. The ion source is at a positive voltage of 250 kVolt relative to the acceleration electrode 26 which forms part of the grounded part 2 of the envelope. The ion beam formed passes the screen electrode 30 and impinges upon the target 27. The target 27 consists of a base plate of a material having a small coefficient of absorption and diffusion for deuterium and tritium (for example copper) and a reaction layer of a material having a large coefficient of absorption for deuterium and tritium. The reaction layer consists of a 5 $\mu$m thick layer of titanium. The target 27 is provided in the neutron generator without being saturated with deuterium and tritium and in the first hours of life of the generator absorbs deuterium and tritium from the ion beam impinging upon the target 27. The absorbed deuterium and tritium cannot diffuse away to any considerable extent to places in the target which are situated deeper than the thickness of the reaction layer because the base plate has a small coefficient of absorption and diffusion for deuterium and tritium. The result is that the reaction layer is saturated with deuterium and tritium to an ever increasing extent so that the neutron yeild begins. The neutron generation results in particular from the reaction between deuterium and tritium. The collision with an energy of 250keV between a deuterium nucleus and a tritium nucleus provides a neutron having an energy of 14 MeV and an $\alpha$-particle having an energy of 3.6 MeV. It is to be noted that neutrons are also formed to a small extent from the reaction between two deuterium nuclei. Said neutrons have a much smaller energy. The neutrons having an energy of 14 MeV form the effective yield of approximately $10^{12}$ neutrons per second of the generator. Said neutron yield is achieved after the generator has been in operation for approximately 1 hour when the saturation of the reaction layer with deuterium and tritium has reached its equilibrium condition.

The screening electrode 30 has a negative potential of a few kV relative to the target 27 so as to prevent secondary electrons which are formed on the target 27 from being accelerated towards the ion source 9. The neutron generator furthermore comprises an ionisation manometer for checking the gas pressure.

The neutron generator may be used inter alia for scientific purposes as activation analysis and due to its large neutron yield and compact construction it is also particularly suitable for medical applications such as cancer therapy, "total body" activation analysis and measurements of the blood circulation.

I claim:

1. Apparatus for making high voltage connection to and cooling an ion source, comprising an ion source having a cooling duct, a first insulator for supporting said ion source, and a detachable high voltage connection comprising a second insulator adapted to fit in spaced relation to said first insulator with a gap therebetween in communication with one end of said cooling duct of said ion source, said second insulator having a duct connecting with the other end of said cooling duct to form a conduit for continuously carrying cooling and insulating fluid through said duct of said second insulator, said cooling duct of said ion source and said gap between said first and second insulators, and a high voltage supply conductor carried by said second insulator for connection across said conduit to said ion source.

2. Apparatus as defined in claim 1 wherein said high voltage supply conductor is coaxial with said duct of said second insulator at least in the vicinity of connection thereof with said ion source.

3. Apparatus as defined in claim 2 wherein said second insulator is conical in the vicinity of said ion source and said duct of said second insulator is coaxial therewith at least in the vicinity of said ion source.

4. Apparatus as defined in claim 3 wherein said apparatus forms part of a neutron generator.

5. Apparatus comprising an ion source at high voltage with respect to metal parts of an envelope, characterized in that said ion source is supported in said envelope by a first fixed insulator which forms part of said envelope and of a detachable high voltage connection, said high voltage connection furthermore comprising a second detachable insulator which has a high voltage supply line and comprises a conical part and an axial duct, and in which an insulating cooling liquid flows in a circuit which is formed by the said axial duct, a cooling circuit in said ion source and a gap between said fixed and detachable insulators.

* * * * *